US010092078B2

(12) United States Patent
Nagata

(10) Patent No.: US 10,092,078 B2
(45) Date of Patent: Oct. 9, 2018

(54) ATOMIZER

(71) Applicant: AIR SURF Inc., Tokyo (JP)

(72) Inventor: Masatoshi Nagata, Tokyo (JP)

(73) Assignee: AIR SURF INC., Tokyo (JP)

( * ) Notice: Subject to any disclaimer, the term of this patent is extended or adjusted under 35 U.S.C. 154(b) by 0 days.

(21) Appl. No.: 15/126,847

(22) PCT Filed: Jan. 9, 2015

(86) PCT No.: PCT/JP2015/050442
§ 371 (c)(1),
(2) Date: Sep. 16, 2016

(87) PCT Pub. No.: WO2015/141244
PCT Pub. Date: Sep. 24, 2015

(65) Prior Publication Data

US 2017/0095052 A1 Apr. 6, 2017

(30) Foreign Application Priority Data

Mar. 19, 2014 (JP) ..... 2014-057148
Mar. 19, 2014 (JP) ..... 2014-057149
Mar. 19, 2014 (JP) ..... 2014-057151

(51) Int. Cl.
*A45D 34/04* (2006.01)
*B05B 7/30* (2006.01)
(Continued)

(52) U.S. Cl.
CPC ..... *A45D 34/04* (2013.01); *B05B 7/2421* (2013.01); *B05B 7/2424* (2013.01);
(Continued)

(58) Field of Classification Search
CPC ..... B05B 7/24; B05B 7/2402; B05B 7/2405; B05B 7/2408; B05B 7/2416;
(Continued)

(56) References Cited

U.S. PATENT DOCUMENTS 1,588,756 A * 6/1926 Leigh ..... B05B 1/3046 239/369
2,889,997 A * 6/1959 Gallo ..... B05B 7/2405 222/399
(Continued)

FOREIGN PATENT DOCUMENTS

JP H02-147259 U1 12/1990
JP 2007-159858 A 6/2007
(Continued)

OTHER PUBLICATIONS

International Search Report, dated Apr. 21, 2015, International Patent Application No. PCT/JP2015/050442, Apr. 21, 2015, with English translation (5 pages).

*Primary Examiner* — Christopher Kim
(74) *Attorney, Agent, or Firm* — Hamre, Schumann, Mueller & Larson, P.C.

(57) ABSTRACT

The present invention addresses the problem of providing an atomizer that is particularly suitable for atomizing a cosmetic. An atomizer (1) for atomizing a coating composition such as a cosmetic using a compressed gas. The atomizer (1) comprises: an atomizer main body (3) provided with a nozzle (8) that is a port for jetting the coating composition; and a gas supply means (30) for supplying the compressed gas to the atomizer main body (3). In the atomizer main body (3), a composition supply tank (2) for supplying the coating composition, an operation part (6) for jetting the coating composition from the nozzle (8) and an insertion part (7), into which a user's fingertip is to be inserted, are formed.

16 Claims, 11 Drawing Sheets

(51) Int. Cl.
*B05B 7/24* (2006.01)
*B05B 15/06* (2006.01)
*B05B 15/62* (2018.01)

(52) U.S. Cl.
CPC ..... *B05B 7/2478* (2013.01); *B05B 15/061* (2013.01); *B05B 15/62* (2018.02)

(58) Field of Classification Search
CPC ... B05B 7/2421; B05B 7/2424; B05B 7/2478; B05B 15/061; A45D 34/04
See application file for complete search history.

(56) References Cited

U.S. PATENT DOCUMENTS

| | | | | |
|---|---|---|---|---|
| 8,087,594 | B2 * | 1/2012 | Navarro ..... | A41G 5/02 239/153 |
| 2005/0284959 | A1 | 12/2005 | Hubmann et al. | |

FOREIGN PATENT DOCUMENTS

| | | | |
|---|---|---|---|
| JP | 2008-504113 | A | 2/2008 |
| JP | 2012506316 | A | 3/2012 |
| JP | 2013-042930 | A | 3/2013 |
| JP | 3182578 | U | 3/2013 |
| JP | 2014500095 | A | 1/2014 |

* cited by examiner

ATOMIZER

FIELD OF THE INVENTION

This invention relates to an atomizer that is designed to be easily handled.

BACKGROUND OF THE INVENTION

Conventional typical applicators for makeup cosmetic materials to skin include hand fingers, sponge, puff, brush, etc.

On the other hand, in recent years, spraying a makeup cosmetic material has been proposed.

For example, Patent Document 1 has described a makeup method using a cosmetic atomizer.

This cosmetic atomizer is provided with an air brush corresponding to an atomizer main body, a hollow gas-use hose interposed between the airbrush and a gas-use hose connector, and a compressor for supplying air to the air brush. The air brush is provided with a nozzle for jetting a cosmetic material, a cosmetic housing cup for use in supplying the cosmetic material, an adjusting lever for adjusting blow amounts of the cosmetic material and a gas-use hose connector to which the gas-use hose for air transportation is inserted.

PRIOR-ART DOCUMENTS

Patent Document

PTL 1: Japanese Patent Application Laid-Open No. 2013-42930

SUMMARY OF THE INVENTION

Problems to be Solved by the Invention

The conventional cosmetic atomizer described in Patent Document 1 is a so-called gun type, that is, a type of atomizer which is held by the hand and a cosmetic material is sprayed by pulling an adjusting lever by a finger, and such an atomizer lacks operability as a tool for carrying out delicate actions, that is, makeup. Moreover, from the viewpoint of being directed toward a face, the gun-type tool is not considered to be desirable.

In particular, in the above-mentioned conventional technique, upon spraying a cosmetic material, while holding the atomizer main body with fingers, the adjusting lever needs to be operated by one of the fingers holding the atomizer, with the result that the atomizer main body becomes unstable in the holding hand, and its operations are complicated, thereby causing a problem to be solved in that the application direction unstably moves.

In order to solve the above-mentioned problem, an object of the present invention is to provide an atomizer that is easily handled and in particular, suitable for spraying a cosmetic material.

Means for Solving the Problem

In order to solve the above-mentioned problem, the present invention relates to an atomizer for spraying a coating composition by using a compressed gas, and the atomizer is characterized by including an atomizer main body provided with a jetting outlet of the coating composition and a gas supply means for supplying the compressed gas to the atomizer main body, and the atomizer main body is provided with a composition supply tank for supplying the coating composition, an operation part for jetting the coating composition from the jetting outlet and an insertion part to which a fingertip of the user is inserted.

Since the atomizer of the present invention is provided with the insertion part to which a fingertip of the user is inserted, the user is allowed to operate the atomizer main body having the jetting outlet, with his or her finger being inserted to the insertion part, thereby making it possible to provide superior operability. In particular, since the fingertip is inserted to the insertion part of the atomizer main body and attached thereto, it is possible to provide a state as if the atomizer main body was directly attached to the fingertip so that the atomizer can be operated by moving the fingertip with superb feelings.

In a preferable mode of the present invention, it is characterized in that the insertion part is formed on an upper portion of the atomizer main body, with an operation part being formed on a side portion of the atomizer main body.

With this configuration, the atomizer main body can be made compact, and a structure with further superior operability can be achieved.

In another preferable mode of the present invention, it is characterized in that the insertion part is disposed such that the insertion direction of the fingertip is substantially the same as the jetting direction of the jetting outlet.

With this configuration, the atomizer can be operated with such delicate feelings as if the spraying composition was applied by using the fingertip.

In still another preferable mode of the present invention, it is characterized in that the insertion part has such a shape as to allow the fingertip of the forefinger to be inserted.

By forming the insertion part into this shape, the atomizer main body can be easily held and the operability can be extremely improved.

Moreover, when attached to the fingertip of the forefinger of the user in this manner, the thumb of the user is located on the operation part formed on a side portion of the atomizer main body, and the middle finger of the user is positioned on a side portion of the atomizer main body on the side opposite to the operation part.

At this time, since the forefinger is inserted into the insertion part, the atomizer main body is attached to the user's hand in a stable state. Moreover, since the middle finger of the user is put along the side portion of the atomizer main body, the above-mentioned stability is further enhanced.

Then, the user can spray a coating composition toward a spraying target by pressing to operate the operation part by the thumb. Since upon pressing to operate the operation part, the middle finger of the user is put along the side portion on the side opposite to the operation part of the atomizer main body, the operating force by the operation part is supported by the middle finger so that shaking of the atomizer main body can be suppressed.

Therefore, since not only a stable attached state is achieved, but also shaking of the atomizer main body at the time of a spraying operation of the coating composition is suppressed, it is possible to ensure stable operability and also to realize fine exquisite application of the coating composition, such as a cosmetic material or the like.

In still another preferable mode of the present invention, it is characterized in that the operation part has an adjusting lever for supplying the compressed gas by the pressing operation by the thumb, and the adjusting lever is provided with a concave face on which the pad portion of the thumb of the user is pressed.

In this manner, since the concave face on which the pad portion of the thumb of the user is pressed is formed on the adjusting lever, it is possible to obtain a good fitting feeling of the thumb relative to the adjustment lever, and consequently to ensure more stable operability.

In still another preferable mode of the present invention, the atomizer main body is characterized in that an attaching opening to which the composition supply tank is detachably attached is formed on the upper portion of the atomizer main body.

With this configuration, the composition supply tank can be detachably attached to the upper portion of the atomizer main body.

In the present invention, it is possible to form a structure in which the gas supply means further comprises a gas-use tank that is attached to the atomizer main body for supplying a compressed gas for use in spraying the cosmetic material, and a coupler to which the gas-use tank is connected is installed in the atomizer main body.

With this configuration, by attaching the cosmetic material tank and the gas-use tank to the atomizer main body, the atomizer is easily set to a using mode.

Then, for example, by inserting the fingertip of the forefinger of the user into the attachment ring, it is attached to the fingertip of the user.

Moreover, since the gas-use tank for supplying a compressed gas required for spraying is directly attached to the atomizer main body, the cosmetic-use atomizer is integrated around the user's hand, without intervening movements of the hand at the time of the applying operation, and from this point of view also, stable operability can be ensured.

Furthermore, the above-mentioned coupler can be formed on substantially the same axis on a rear portion in the spraying direction of the atomizer main body, and the above-mentioned gas-use tank to be connected to the coupler can be formed so as to be positioned on substantially the same axis as the spraying direction of the cosmetic material.

With this configuration, in a state where the atomizer main body is attached to the fingertip, the above-mentioned gas-use tank can be positioned so as to be mounted on a side portion of the hand.

Thus, the above-mentioned atomizer as a whole can be held by the user's hand, it is possible to ensure stability of the atomizer at the time of makeup and also to realize a fine exquisite application.

Moreover, the above-mentioned coupler can be formed on substantially the same axis on the rear portion in the spraying direction of the atomizer main body and the above-mentioned gas-use tank to be connected to the coupler is positioned below the atomizer main body so as to be located inside the palm of the user's hand.

With this configuration, by supporting the above-mentioned gas-use tank so as to be surrounded by the palm of the user's hand, the stability at the time of use of the atomizer can be further improved.

Moreover, the above-mentioned coupler can be installed so as to cross the spraying direction of the cosmetic material, and the above-mentioned gas-use tank to be connected to the coupler is positioned below the atomizer main body so as to be located inside the palm of the user's hand.

Furthermore, on the peripheral surface of the gas-use tank, a concave portion along which the finger of the user is put may be formed in a state where the gas-use tank is positioned inside the palm of the user's hand.

With this configuration, it becomes possible to prevent the above-mentioned gas-use tank and the finger of the user from slipping from each other so as to be used in more stable manner.

Moreover, the above-mentioned gas supply means is constituted by the tank main body for housing a compressed gas and the gas-use hose for supplying the compressed gas from the tank main body to the atomizer main body so that the tank main body can be designed to be attachable to the arm of the user of the atomizer main body.

With this configuration, the tank main body is attached to the arm of the user so that the gas-use hose only needs a very short length for connecting the atomizer main body and the tank main body.

Therefore, different from the prior-art, it becomes possible to completely prevent the gas-use hose from becoming resistance to the operation of the atomizer main body or from getting entangled to the arm of the user.

That is, by making the tank main body attachable to the arm of the user, the atomizer as a whole can be integrated around the hand or arm of the user. Thus, it is possible to ensure stable operability without intervening movements of the hand or arm at the time of the applying operation.

In still another preferable mode of the present invention, the atomizer main body is characterized by being attachable to the wrist or the vicinity of the wrist.

With this configuration, since upon moving the atomizer main body toward a spraying target delicately, the tank main body is allowed to follow up the movement of the atomizer main body, it is possible to realize smooth operability.

In still another preferable mode of the present invention, the above-mentioned gas-use hose is characterized by being detachably connected to at least either the atomizer main body or the tank main body.

With this configuration, it becomes possible to easily carry out the exchange work for the used gas-use tank and the exchange work only for the tank main body, etc.

In still another preferable mode of the present invention, the tank main body is characterized by being formed into a curved shape so as to have two ends that are closely located and provided with a coupling metal fitting for connecting the gas-use hose to the tank main body, and the tank main body is also characterized by being formed by an elastic material.

When the tank main body is formed in this manner, it becomes not necessary to form an attaching means separately, and the tank main body is formed into a simple structure so that its attaching operation to the arm, wrist or the like can be easily carried out.

In the other preferable mode of the present invention, the tank main body is characterized by having an attaching member attachable to the arm.

When the tank main body is formed in this manner also, the tank main body is formed into a simple structure so that its attaching operation to the arm, wrist or the like can be easily carried out.

Effects of the Invention

The atomizer of the present invention exerts a superior operability, for example, in the case when delicate movements are required, such as in makeup. Moreover, the atomizer of the present invention has such a soft image as if a coating composition was sprayed from a fingertip.

DETAILED DESCRIPTION OF THE INVENTION

Embodiment 1

Figure 1:
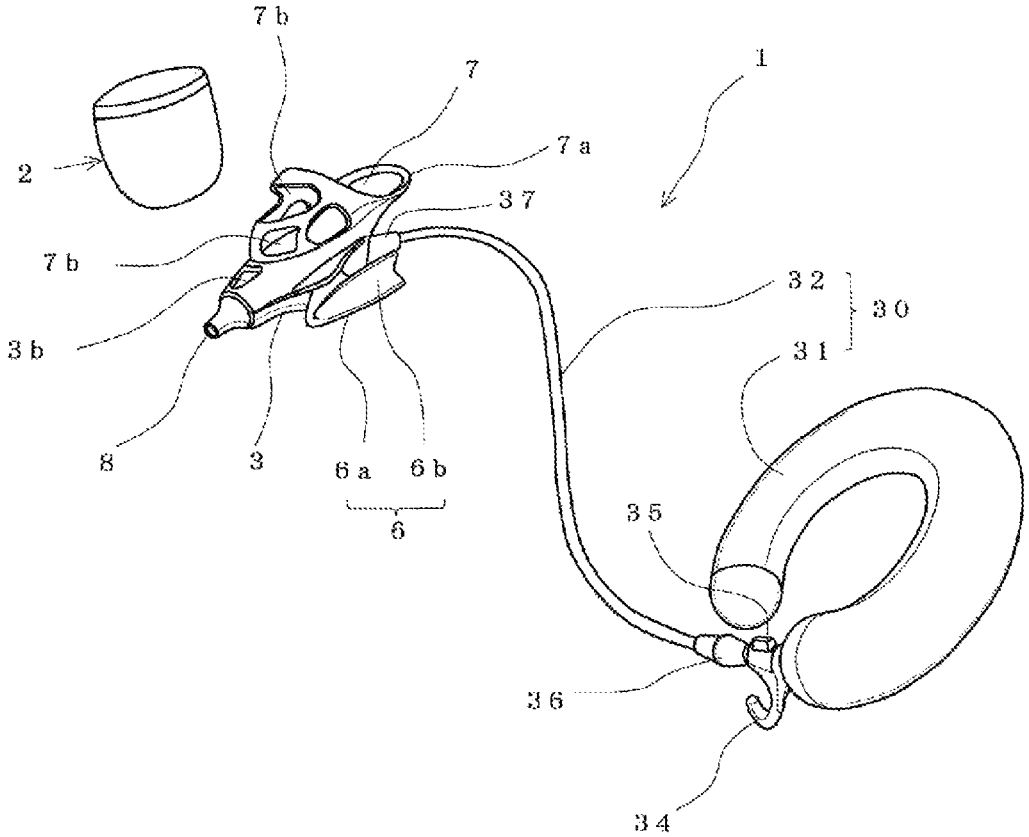
FIG. 1 is a perspective view showing an atomizer in accordance with embodiment 1 of the present invention.
Figure 2:
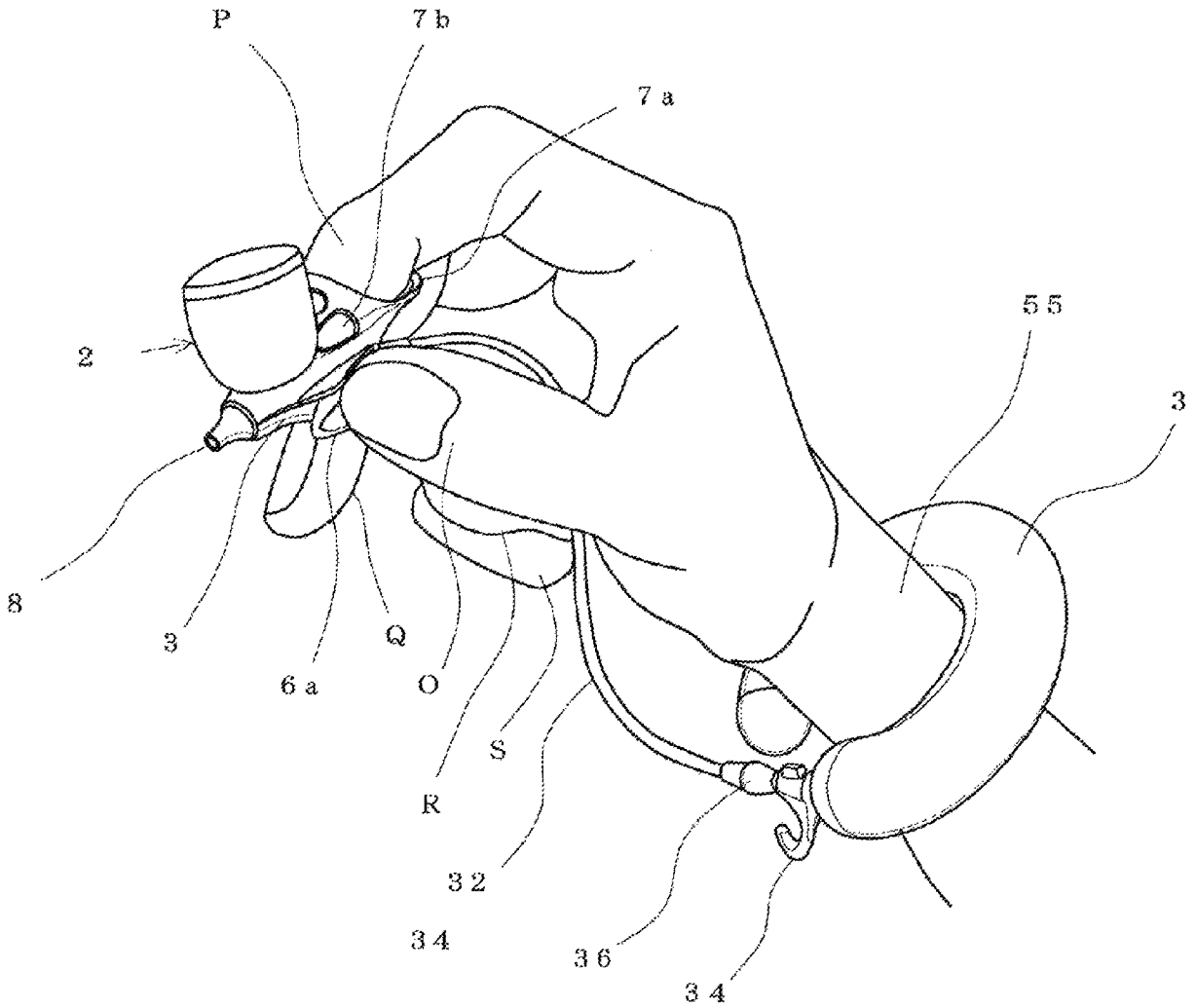
FIG. 2 is a perspective view showing a use mode of the atomizer in accordance with embodiment 1 of the present invention.
Figure 3:
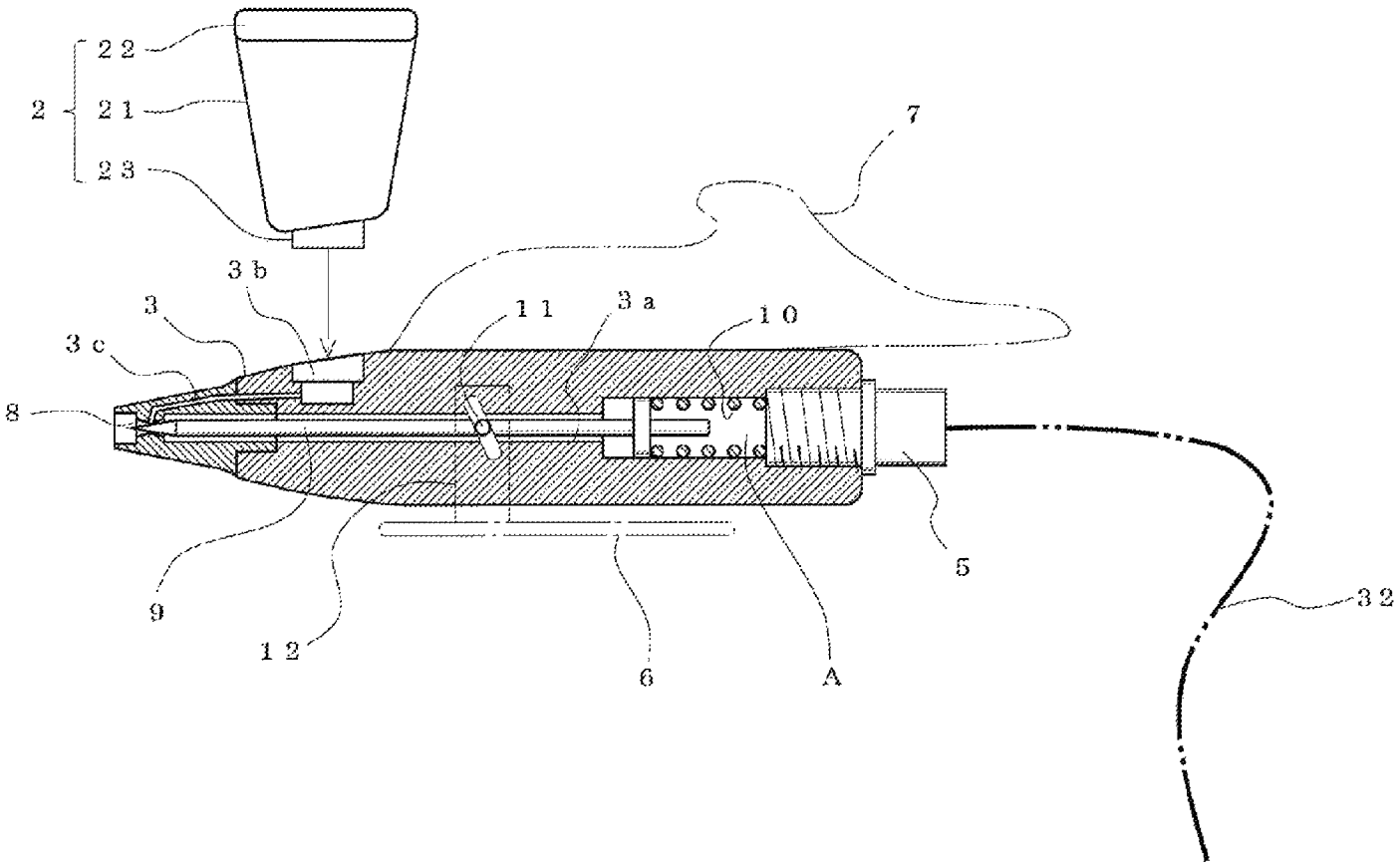
FIG. 3 is a cross-sectional view showing essential portions of the atomizer in accordance with embodiment 1 of the present invention.

Referring to FIG. 1 to FIG. 3, the following description will explain an atomizer in accordance with embodiment 1 of the present invention in detail.

An atomizer 1 in accordance with embodiment 1 is an atomizer for applying a cosmetic material. The atomizer 1 is provided with an atomizer main body 3 having a jetting outlet (nozzle) 8 for a cosmetic material and a gas supply means 30 for supplying a compressed gas to the atomizer main body 3.

The gas supply means 30 is provided with a gas-use tank 31 for housing a compressed gas and a hollow gas-use hose 32 for supplying the compressed gas inside the gas-use tank 31 to the atomizer main body 3. On a connection part between the gas-use tank 31 and the gas-use hose 32, a hook 34 whose usage is not limited is installed. The gas-use tank 31 is curved to be formed into a substantially C-letter shape, and as shown in FIG. 2, is designed to be attachable to the wrist or the like.

As a material for the gas-use tank 31, various materials including a reinforced plastic material containing light metal, carbon fibers or the like, a hard rubber or a composite material of these, etc., may be used. In the case of a configuration of the gas-use tank 31 to be attached to the wrist or the like, a material having slight flexibility is preferably used. Moreover, one of the ends of the gas-use hose 31 is detachably coupled to the gas-use tank 31 through a coupling metal fitting 36. The coupling metal fitting 36 is released from its coupled state by pressing to operate a key button 35.

On the other hand, an attaching opening **3*b* through which a composition supply tank (referred to as "cosmetic material tank") 2 to be filled with a cosmetic material is attached is formed on an upper portion of the atomizer main body 3**.

A coupler 5 (see FIG. 3) to which a coupling metal fitting 37 for the gas-use hose 32 is attached is formed on the rear end of the atomizer main body 3.

Moreover, on the above-mentioned atomizer main body 3, an operation part 6 having an adjusting lever **6*a* for adjusting a spraying amount of the cosmetic material and an insertion part 7 through which the fingertip of the user is inserted from the rear side of the atomizer main body 3 are installed, and in this structure, the adjusting lever 6*a* is installed on a side portion of the atomizer main body 3 and the insertion part 7 is formed on an upper portion of the atomizer main body 3**.

As shown in FIG. 3, the atomizer main body 3 is provided with a through hole **3*a* formed along its center axis line, and inside this through hole 3*a*, a nozzle 8 for spraying the cosmetic material into a mist state, a needle valve 9 for use in adjusting the opening degree of the nozzle 8 by being moved in the length direction of the through hole 3*a* and a return spring 10 for applying a force to the needle valve 9 toward a position for closing the nozzle 8** are formed at its tip (left side in the drawing).

Moreover, the rear portion of the through hole **3*a* is formed so as to make its inner diameter large and consequently to form an accumulator A for the compressed gas, and inside this accumulator A, the return spring 10** is installed.

To the rear end of the through hole **3*a*, a coupler 5 that constitutes the accumulator A by closing the rear end of the through hole 3*a* is attached, and between the coupler 5 and the needle valve 9, the return spring 10** is interpolated in a compressed state.

Moreover, in an intermediate portion of the atomizer main body 3, the attaching opening **3*b* to which the cosmetic material tank 2** is attached is formed with its opening facing upward.

This attaching opening **3*b* is allowed to communicate with the inside of the nozzle 8 through a cosmetic material supply passage 3*c* formed inside the atomizer main body 3**.

On the other hand, in a substantially intermediate portion of the needle valve 9, a cam follower 11 is formed so as to protrude in a manner to be orthogonal to its axis line. With the cam follower 11, a cam 12, which is formed integrally with the adjusting lever **6*a*, and is inserted into the atomizer main body 3** so as to freely move therein, is engaged.

Moreover, upon pressing the adjusting lever **6*a* toward the atomizer main body 3, by the cooperative operation of the cam 12 and the cam follower 11, the needle valve 9 is moved against an applied force from the return spring 10 so that the nozzle 8** is opened.

Furthermore, by releasing the pressing force to the adjusting lever 6, the needle valve 9 is allowed to move in such a direction as to close the nozzle 8, while returning the adjusting lever **6*a*** to its original position.

The coupling metal fitting 37 of the gas supply means 30 is designed to be connected to the atomizer main body 3 through the coupler 5.

In the connected state, a compressed gas (for example, air) is sent to the accumulator A from the gas-use tank 31.

The compressed gas sent to the accumulator A is designed to be sent to the nozzle 8 through the through hole **3*a* when the adjusting lever 6*a* is operated so that the nozzle 8** is opened.

In the nozzle 8, a negative pressure is generated inside thereof when the compressed gas is sent thereto as described above.

By this negative pressure, a cosmetic material is sucked from the cosmetic material supply passage 3*c* that is communicated with the nozzle 8, and the cosmetic material is sprayed while being crushed into a mist state, by a jetting force of the compressed gas.

Moreover, in the present embodiment, the coupler 5 is attached to the same axis as the through hole 3*a*, and the coupling metal fitting 37 of the gas-use hose 32 is formed into a cylindrical shape, and connected to the same axis as the coupler 5.

On the other hand, the insertion part 7 has a substantially cylindrical shape with its rear side opened, and is formed with the rear side having a slightly larger inner diameter so that, for example, the fingertip of the forefinger of the user is smoothly inserted thereto.

As shown in FIG. 2, the insertion part 7 is formed into such a shape that the fingertip of a forefinger P can be inserted in a jetting direction of the nozzle 8.

The insertion part 7 in the illustrated example is formed so as to have a cavity in which the fingertip up to about the first joint of the forefinger can be inserted.

Moreover, a support member 7*a* for supporting the pad portion of the fingertip is formed.

Furthermore, the insertion part 7 is provided with a plurality of air-permeable holes 7*b* for improving the air-permeability to the fingertip inside the insertion part 7.

As shown in FIG. 3, in the present embodiment, the above-mentioned cosmetic material tank 2, which is detachably attached to the atomizer main body 3, is provided with a tank main body 21 for housing a cosmetic material, a lid 22 thereof, and an attaching part 23 formed on a lower portion of the tank main body 21.

This attaching part 23 compatibly serves as a jetting outlet for the cosmetic material, and is attached to the attaching opening 3*b* of the atomizer main body 2 in a liquid-tight state.

In the present embodiment, the jetting outlet of the attaching part 23 of the cosmetic material tank 2 is closed by a breakable film (not shown), and at the time of attaching to the attaching opening 3*b*, the film is designed to be broken by a protrusion (not shown) formed inside the attaching opening 3*b*.

The operation part 6 has the adjusting lever 6*a* for supplying a compressed gas by a pressing operation by a thumb O. The insertion part 7 is formed on the upper portion of the atomizer main body 1, and the operation part 6 is formed on a side portion of the atomizer main body 3.

Thus, as shown in FIG. 2, an arrangement is made such that in a mode in which the fingertip of the forefinger P and the fingertip of the thumb O are placed closely to each other, with the thumb O and a middle finger Q being opposed to each other, the adjusting lever 6*a* is pressed and operated stably by the fingertip of the thumb.

As shown in FIG. 1, a concave face 6*b* which is designed so as to make the pad portion of the fingertip of the thumb tightly in contact therewith is formed on the adjusting lever 6*a*.

With this mode, the atomizer main body 3 is stably held by the forefinger and the thumb, and the cosmetic material can be sprayed by using a simple operation.

Next, the following description will explain a using method of the atomizer 1 in accordance with the present embodiment formed in this manner.

First, the cosmetic material tank 2 filled with a cosmetic material is attached to the attaching opening 3*b* of the atomizer main body 3, as well as attaching the gas-use hose 32 to the coupler 5 through the coupling metal fitting 37. Thus, the atomizer main body 3 and the gas-use hose 32 are assembled with each other.

As shown in FIG. 2, the atomizer 1 assembled in this manner is attached to the user, for example, by allowing the user to insert the fingertip of the forefinger P into the insertion part 7.

In this state, when the user moves the respective fingers so as to hold the atomizer main body 3, the thumb O of the user is naturally made in contact with the adjusting lever 6*a*, and the middle finger Q is made in contact with the side portion on the opposite side to the adjusting lever 6*a* of the atomizer main body 3, and by further attaching the gas-use tank 31 of the gas supply means 30 to the wrist of the user, the atomizer 1 as a whole is held by the user's hand.

Therefore, the atomizer 1 has its atomizer main body 3 fitted around the forefinger P by the insertion part 7, while being supported by three points of the two side portions and the upper portion, and the gas-use tank 31 and the gas-use hose 32 are further supported in a manner so as to be mounted on the user's hand among the thumb O, the forefinger P and a wrist 55. As a result, the atomizer 1 is held by the user in a stable state.

Then, the spraying of the cosmetic material, that is, the application of the cosmetic material, is carried out by moving the thumb O so as to press the adjusting lever 6*a* toward the atomizer main body 3.

At the time of the operation of the adjusting lever 6*a* by the thumb O, the pressing force is supported by the middle finger Q made in contact with the opposite side to the atomizer main body 3, it is possible to suppress the atomizer 1 from shaking at the time of the application operation.

In this manner, the atomizer 1 in accordance with the present embodiment is held in a stable state in a mode attached to the user's hand, and is suppressed from shaking even at the time of application.

Therefore, by realizing a stable application operation, it becomes possible to carry out exquisite superior makeup.

Furthermore, since all the members of the cosmetic-use atomizer 1 are integrated around the user's hand, without anything intervening movements of the user's hand, smooth movements can be obtained, and from this point of view also, superior makeup can be ensured.

In accordance with the present embodiment, since the atomizer 1 is provided with the insertion part 7 through which the fingertip of the user is inserted, the atomizer main body 3 having the nozzle 8 can be operated, with the fingertip being inserted into the insertion part 7, so that extremely superior operability can be obtained. In particular, since the fingertip is inserted to the insertion part 7 of the atomizer main body 3 and attached thereto, it is possible to provide a state as if the atomizer main body 3 was directly attached to the fingertip so that it becomes possible to carry out a makeup process onto a face or a body with a mist spray by moving the fingertip with superb feelings.

Moreover, by designing the insertion part 7 to have the fingertip insertion direction that is substantially the same direction as the jetting direction of the nozzle 8, the atomizer 1 can be operated with such delicate feelings as if the cosmetic material was applied by using the fingertip.

Furthermore, by forming the insertion part 7 into a shape to which the fingertip of the forefinger can be inserted, the atomizer main body 3 can be easily held by the fingers, thereby making it possible to extremely improve the fine operability.

The above-mentioned gas supply means 30 is provided with the gas-use tank 31 for housing a compressed gas and the gas-use hose 32 for supplying the compressed gas from the gas-use tank 31 to the atomizer main body 2, and as shown in FIG. 2, the gas-use tank 31 itself has such a shape as to be attachable to the vicinity of the wrist 55. By using such a mode, in the case when the atomizer main body 2 is delicately moved to the application target, since the movement of the gas-use tank 31 is allowed to follow the movement of the atomizer main body 3, it is possible to achieve smooth operability.

Additionally, the above-mentioned embodiment has exemplified a structure in which the gas-use tank 31 is temporarily attachable to the wrist; however, the present invention is not intended to be limited by this structure, and for example, a structure in which the gas-use hose 32 is lengthened and connected to a gas-use tank of an installation type or a structure in which it is connected to an air compressor may be used.

Embodiment 2

Figure 4:
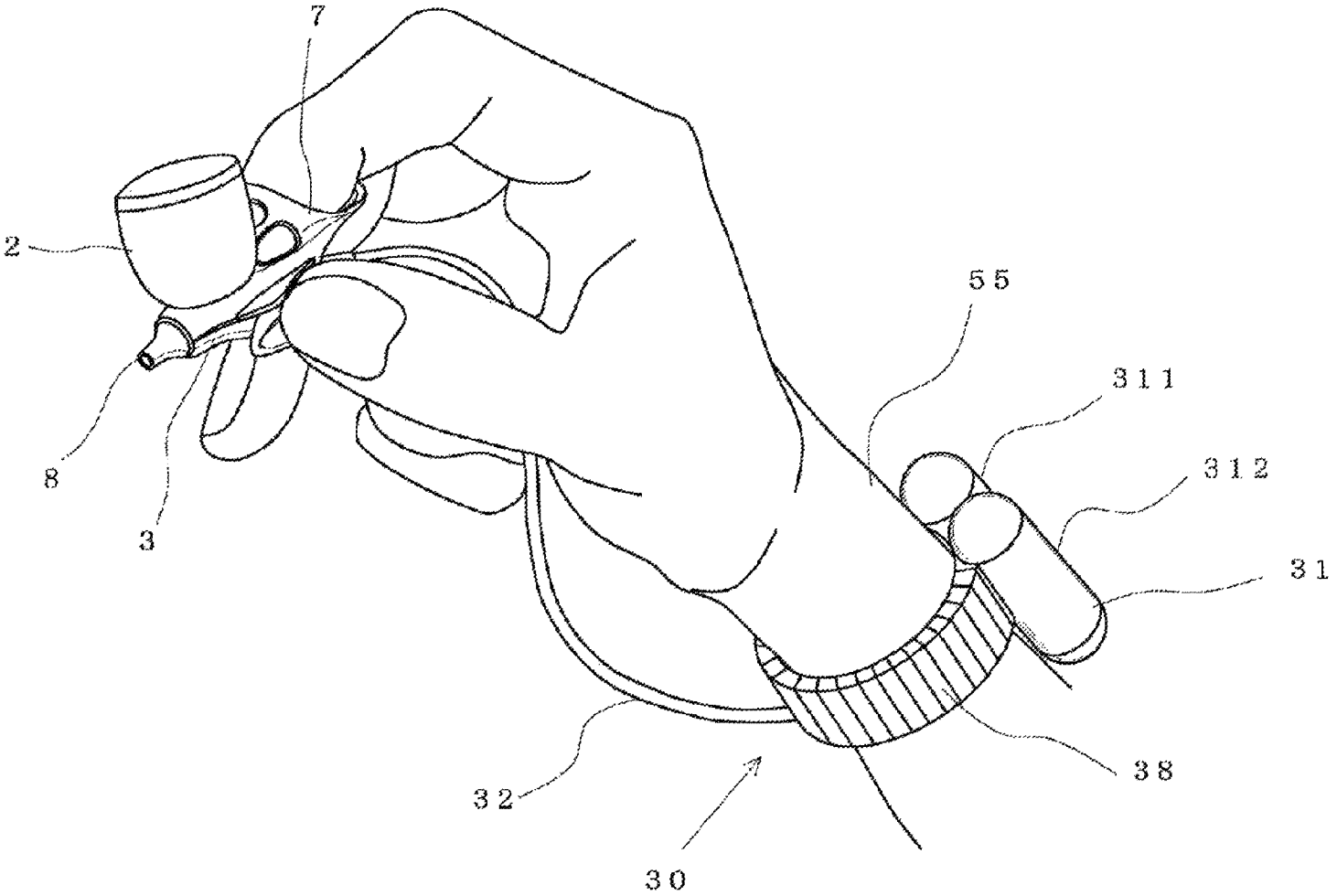
FIG. 4 is a perspective view showing a use mode of an atomizer in accordance with embodiment 2 of the present invention.
Figure 5:
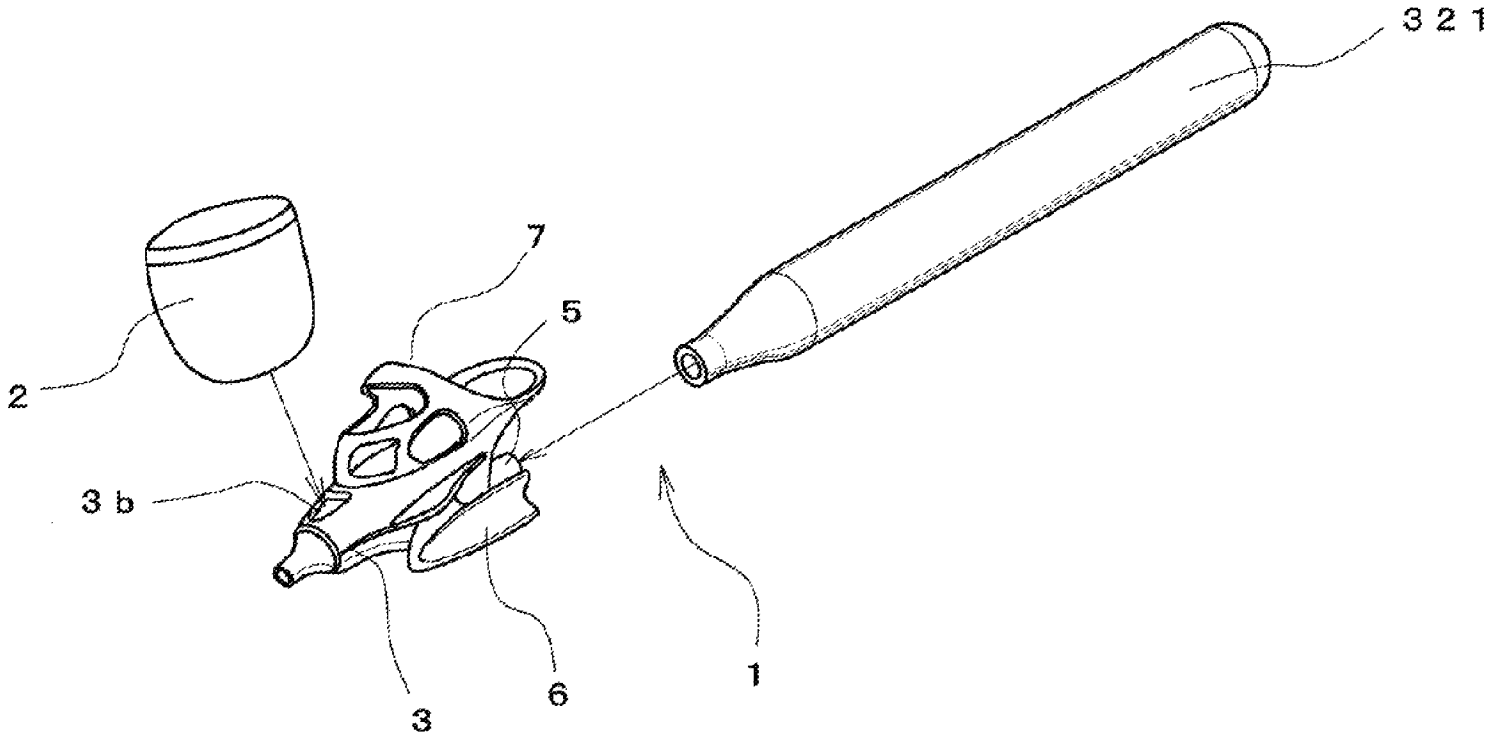
FIG. 5 is an exploded perspective view showing an atomizer in accordance with embodiment 3 of the present invention.

FIG. 4 is a perspective view showing a use mode in accordance with embodiment 2 of the present invention. Additionally, in the drawing, those components basically the same as those of embodiment 1 are indicated by the same reference numerals, and the explanations thereof will be omitted.

In an atomizer 1 of embodiment 2, the tank main body 31 is provided with an attaching member 38 that can be attached to the wrist 55 or arm and two unit tanks 311 and 312 that are installed on the attaching member 38.

The above-mentioned attaching member 38 is formed by a flexible annular belt whose inner diameter can be expanded and reduced. Each of the unit tanks 311 and 312 is a hollow cylindrical tank, and two of these are installed in parallel with each other.

In this case, as the attaching member 38, not limited by the annular belt, a commercially available band or the like provided with fastening metal fittings or the like may be used.

In the case when the tank main body 31 is formed in this manner also, the structure of the tank main body 31 can be simplified so that the attaching operation to the arm, wrist 55, or the like can be easily carried out.

Additionally, the above-mentioned embodiment has exemplified a structure in which the tank main body 31 is temporarily attachable to the wrist; however, the present invention is not intended to be limited by this structure, for example, a structure in which the gas-use hose 32 is lengthened so as to be attachable to an arm portion other than the wrist may be used.

Embodiment 3

Referring to FIG. 1 to FIG. 7, the following description will explain embodiment 3 of the present invention.

Additionally, in embodiment 3, those components that are in common with those of the aforementioned other embodiments are indicated by the same reference numerals, and the explanations thereof will be omitted.

In the present embodiment, the above-mentioned coupler 5 is attached to the same axis as the through hole 3*a*, and a gas-use tank 321 is formed into a cylindrical shape, and connected to the same axis as the coupler 5.

Next, the following description will explain a using method of the atomizer 1 in accordance with the present embodiment formed in this manner.

First, the cosmetic material tank 2 filled with a cosmetic material is attached to the attaching opening 3*b* of the atomizer main body 3, as well as attaching the gas-use tank 321 thereto through the coupler 5.

Figure 6:
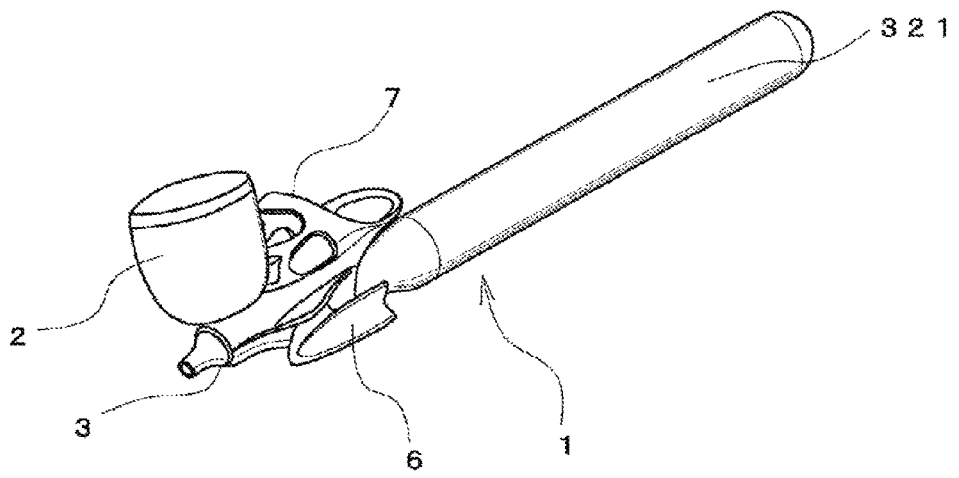
FIG. 6 is a perspective view showing the atomizer in accordance with embodiment 3 of the present invention.

Thus, the atomizer main body 3 and the gas-use tank 321 are linearly assembled as shown in FIG. 6.

Figure 7:
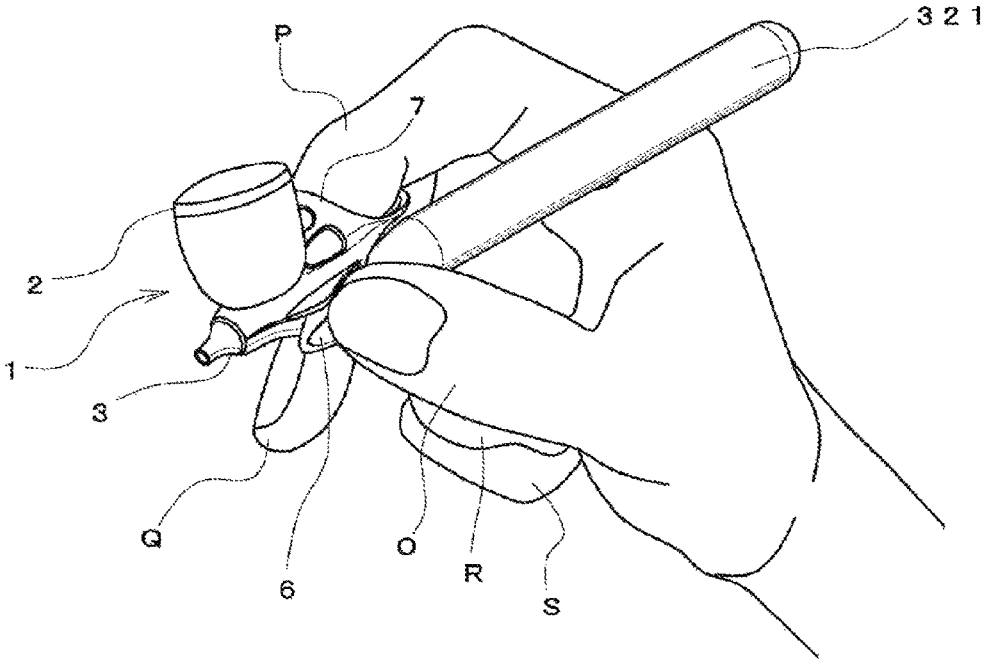
FIG. 7 is a perspective view showing a use mode of the atomizer in accordance with embodiment 3 of the present invention.

As shown in FIG. 7, the atomizer 1 thus assembled is attached to the user, for example, by allowing the user to insert the fingertip of the forefinger P to an attachment ring 7 of the atomizer 1.

In this state, when the user moves the respective fingers so as to hold the atomizer main body 3, the thumb O of the user is naturally made in contact with the adjusting lever 6, and the middle finger Q is made in contact with the side portion on the opposite side to the adjusting lever 6 of the atomizer main body 3, and by further allowing the gas-use tank 321 to be positioned on the user's hand between the thumb O and the forefinger P, the atomizer 1 is held by the user's hand.

Therefore, the atomizer 1 has its atomizer main body 3 fitted around the forefinger P by the attachment ring 7, while being supported by three points of the two side portions and the upper portion, and as shown in FIG. 7, the gas-use tank 321 is supported in a manner so as to be mounted on the user's hand between the thumb O and the forefinger P.

As a result, the atomizer 1 is held by the user in a stable state.

Then, the spraying of the cosmetic material, that is, the application of the cosmetic material, is carried out by moving the thumb O so as to press the adjusting lever 6 toward the atomizer main body 3.

At the time of the operation of the adjusting lever 6 by the thumb O, the pressing force is supported by the middle finger Q made in contact with the opposite side of the atomizer main body 3 so that it becomes possible to suppress the atomizer 1 from shaking at the time of the application operation.

In this manner, the atomizer 1 in accordance with the present embodiment is held in a stable state in its state attached to the user's hand, and is suppressed from shaking even at the time of application.

Therefore, by realizing a stable application operation, it becomes possible to carry out exquisite superior makeup.

Furthermore, since all the members of the cosmetic-use atomizer 1 are integrated around the user's hand, without anything intervening movements of the user's hand, smooth movements can be obtained, and from this point of view also, superior makeup can be ensured.

Embodiment 4

Figure 8:
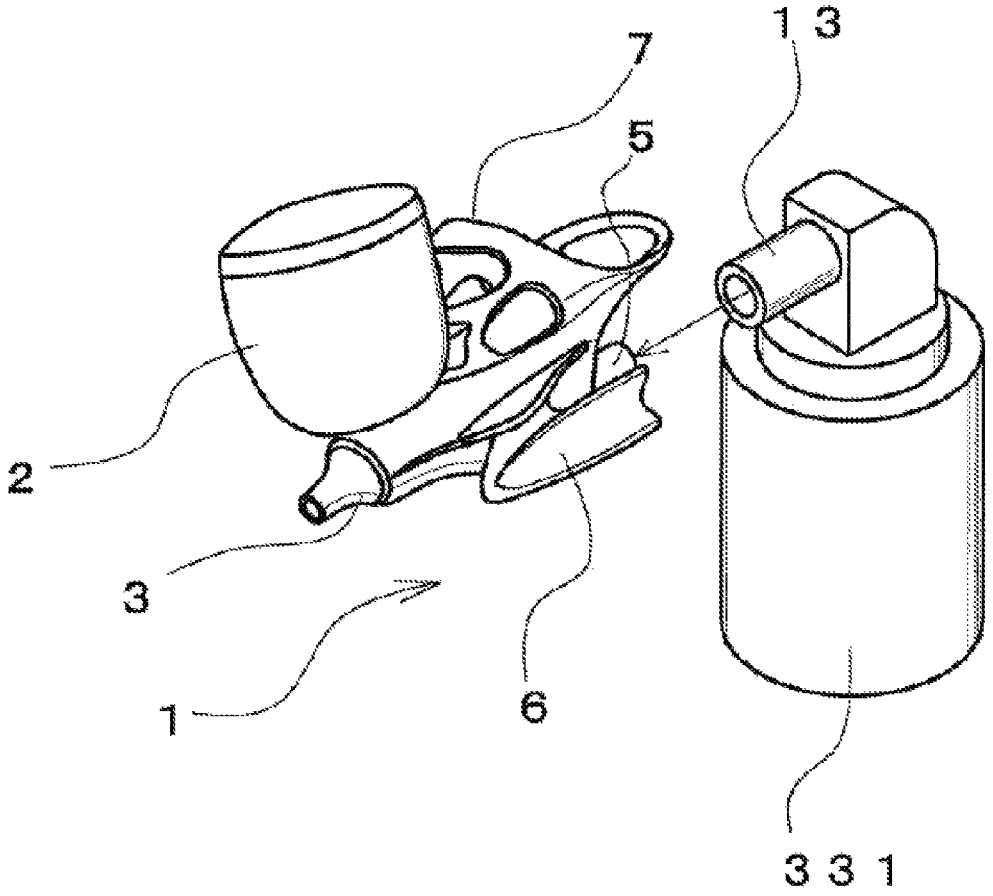
FIG. 8 is an exploded perspective view showing an atomizer in accordance with embodiment 4 of the present invention.
Figure 9:
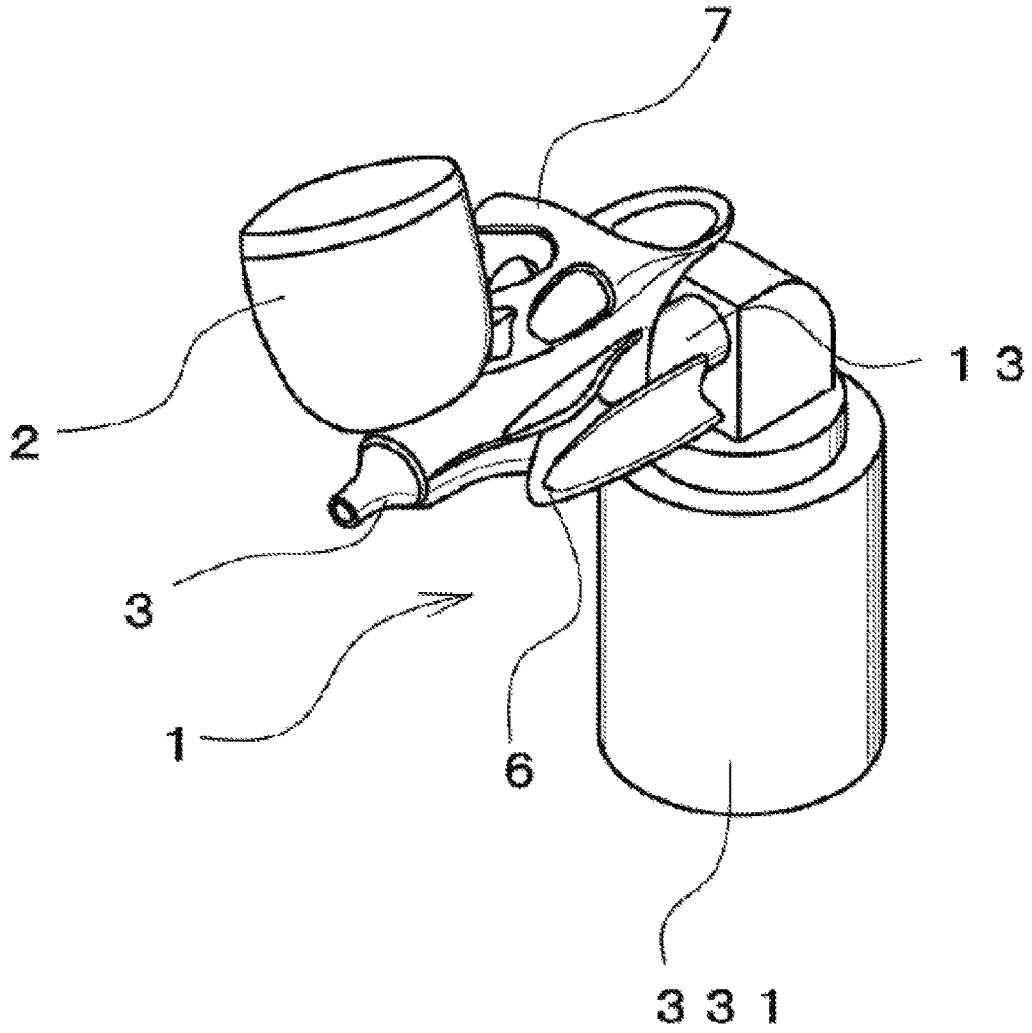
FIG. 9 is a perspective view showing the atomizer in accordance with embodiment 4 of the present invention.
Figure 10:
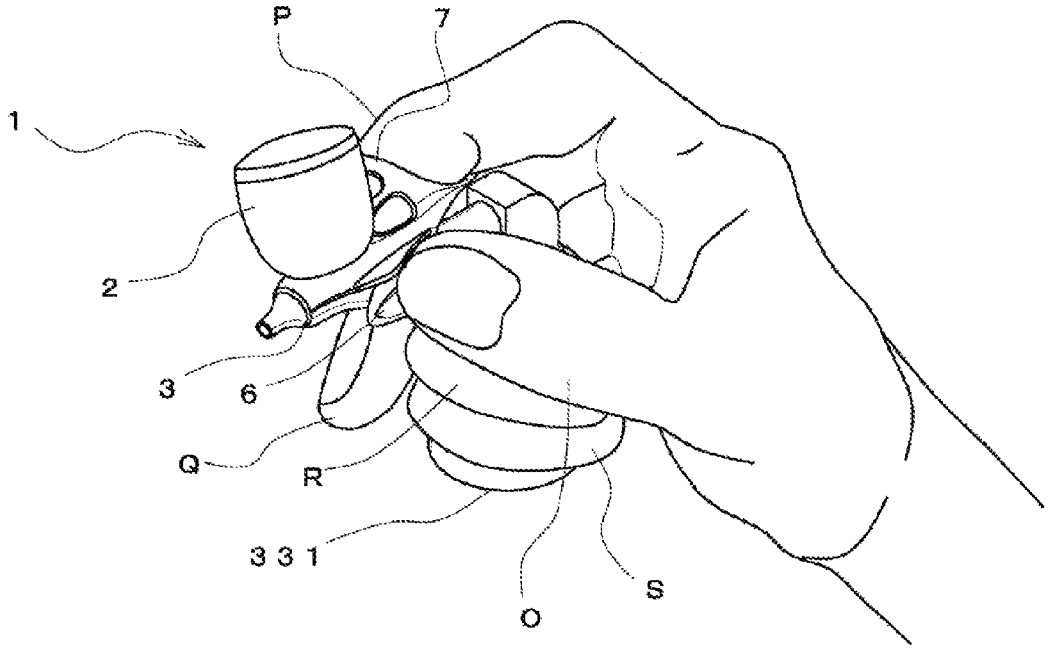
FIG. 10 is a perspective view showing a use mode of the atomizer in accordance with embodiment 4 of the present invention.

Referring to FIG. 8 to FIG. 10, the following description will explain embodiment 4 of the present invention.

The present embodiment, which modifies the gas-use tank 331, has a configuration in which a connection member 13 to the above-mentioned coupler 5 to be formed in the gas-use tank 331 protrudes so as to intersect with the length direction of the gas-use tank 331.

With this configuration, when the gas-use tank 331 is attached to the atomizer main body 3, the gas-use tank 331 is located below the atomizer main body 3, as shown in FIG. 9, and when attached to the user's hand, the gas-use tank 331 is located on the inner side of the user's hand, as shown in FIG. 10.

Moreover, when the gas-use tank 331 is positioned on the inner side of the palm of the hand, the gas-use tank 331 can be supported by grabbing the surrounding portion of the gas-use tank 331 with the ring finger R and little finger S other than the thumb O, the forefinger P and the middle finger Q for supporting the atomizer main body 3 so that the atomizer 1 can be held in a more stable state.

Embodiment 5

Figure 11:
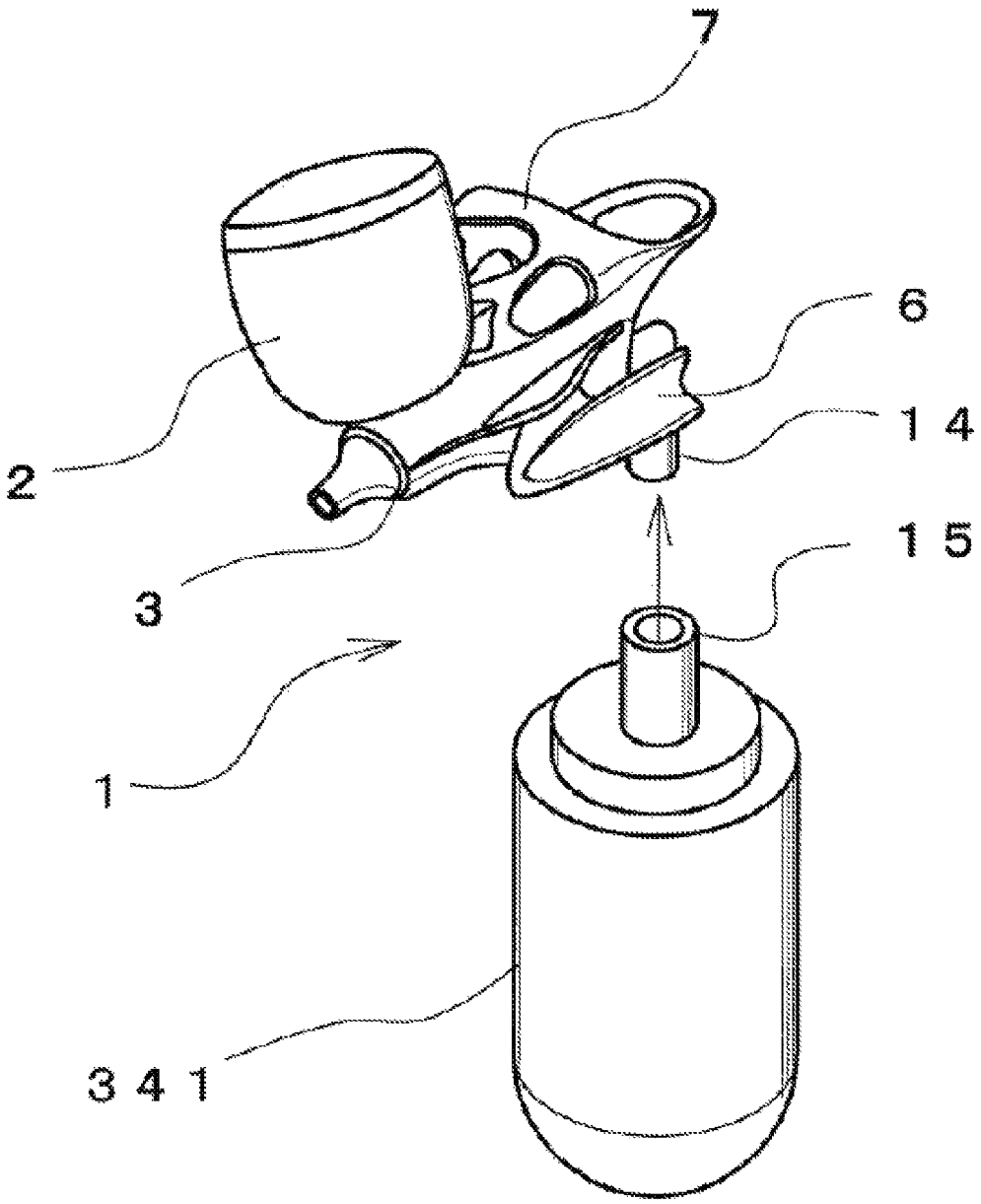
FIG. 11 is an exploded perspective view showing an atomizer in accordance with embodiment 5 of the present invention.

FIG. 11 shows embodiment 5 of the present invention.

In the same manner as in embodiment 4, the present embodiment has a configuration in which a coupler 14 to be installed in the atomizer main body 3 is bent downward so as to allow a gas-use tank 341 to be located below the atomizer main body 3.

Moreover, a connection member 15 to be formed in the gas-use tank 341 and connected to the coupler 14 is formed on an upper end of the gas-use tank 341 along its axial line direction.

In the present embodiment formed in this manner also, the same functions and effects as those of the aforementioned embodiment 4 can be obtained.

Embodiment 6

Figure 12:
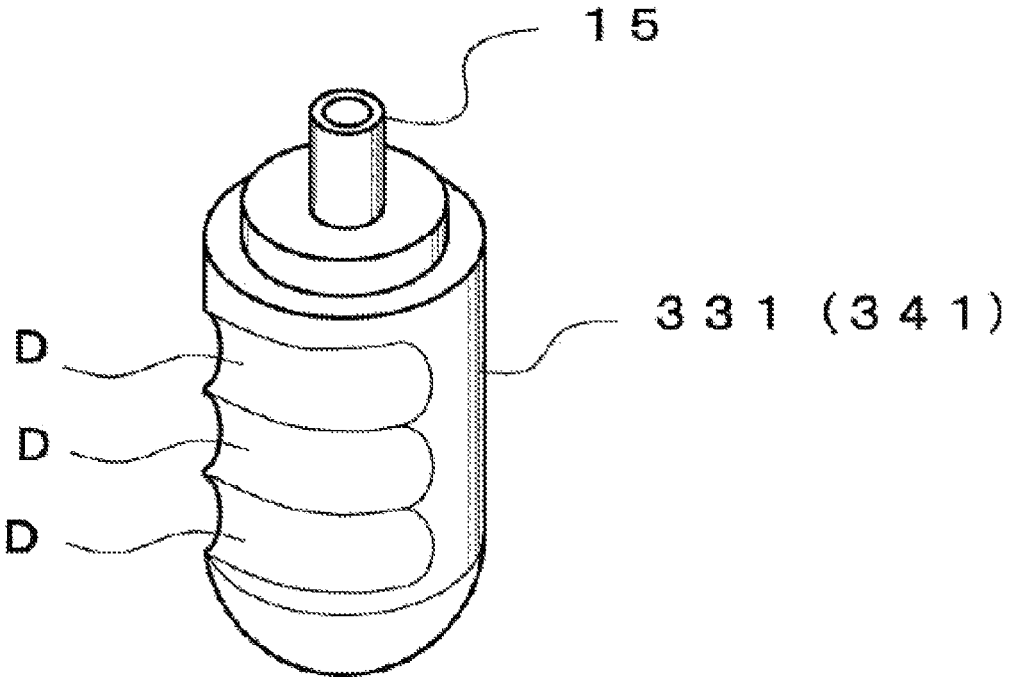
FIG. 12 is a perspective view showing a gas-use tank in accordance with embodiment 6 of the present invention.

Moreover, FIG. 12 shows embodiment 6 of the present invention. This embodiment has a configuration in which on the outer peripheral surface of each of the gas-use tanks 331 and 341 in the above-mentioned embodiment 4 and embodiment 5, a concave portion D along which the user's fingers are put, with the gas-use tank 331 or 341 being positioned on the inside of the palm of the user's hand, is formed.

With this arrangement, by preventing the fingers grabbing the gas-use tank 331 or 341 from slipping off, the holding of the atomizer 1 of the present embodiment can be made more stable.

In each of the above-mentioned embodiments, the cosmetic atomizer has been exemplified; however, the present invention is not intended to be limited by this, and can be applied to another atomizer other than those for use in cosmetics.

For example, the present invention can be applied to atomizers of various coating compositions, for example, such as paints for use in drawings, coatings or the like.

INDUSTRIAL APPLICABILITY

The present invention can be applied to a spraying process of various coating compositions, in addition to the spraying process of cosmetic materials.

REFERENCE SIGNS LIST

1 . . . atomizer
2 . . . cosmetic material tank (composition supply tank)
3 . . . atomizer main body
3*a* . . . through hole
3*b* . . . attaching opening
3*c* . . . cosmetic material supply passage
30 . . . gas supply means
31 . . . gas-use tank
32 . . . gas-use hose
38 . . . attaching member
311 . . . unit tank
312 . . . unit tank
321 . . . gas-use tank
331 . . . gas-use tank
341 . . . gas-use tank
5 . . . coupler
55 . . . wrist
6 . . . operation part
6*a* . . . adjusting lever
6*b* . . . concave face
7 . . . insertion part
8 . . . nozzle
9 . . . needle valve
10 . . . return spring
11 . . . cam follower
12 . . . cam
13 . . . connection member
14 . . . coupler
15 . . . connection member
A . . . accumulator
D . . . concave portion
O . . . thumb
P . . . forefinger
Q . . . middle finger
R . . . ring finger
S . . . little finger

The invention claimed is:

1. An atomizer for spraying a coating composition by using a compressed gas, comprising:
- an atomizer main body provided with a jetting outlet for the coating composition;
- a gas supply means for supplying the compressed gas to the atomizer main body; and
- a composition supply tank for supplying the coating composition,
- wherein the atomizer main body comprises an operation part for allowing the coating composition to be sprayed from the jetting outlet,
  - an insertion part to which a fingertip of a user's finger is inserted, and
  - an attaching opening to which the composition supply tank is detachably attached,
- wherein the attaching opening is provided between the insertion part and the jetting outlet, and the attaching opening faces upward,
- wherein the insertion part has a substantially cylindrical shape, the insertion part has a front side and a rear side, the rear side is open and has an inner diameter that is larger than an inner diameter of the front side, and
- wherein the operation part is operated with a thumb of the user and while the fingertip is inserted into the insertion part.

2. The atomizer according to claim 1, wherein the insertion part is formed on an upper portion of the atomizer main body and the operation part is formed on a side portion of the atomizer main body.

3. The atomizer according to claim 1, wherein the insertion part is disposed so that an insertion direction of a fingertip is set in substantially the same direction as a jetting direction of the jetting outlet.

4. The atomizer according to claim 1, wherein the insertion part has a shape to which the fingertip of a forefinger is insertable.

5. The atomizer according to claim 1, wherein the operation part has an adjusting lever for supplying the compressed air by a pressing process by the thumb and the adjusting lever is provided with a concave face formed thereon on which the pad portion of the thumb of the user is put.

6. The atomizer according to claim 1, wherein the gas supply means further comprises a gas-use tank that is attached to the atomizer main body for supplying a compressed gas for use in spraying the coating composition, and a coupler to which the gas-use tank is connected is installed in the atomizer main body.

7. The atomizer according to claim 6, wherein the coupler is installed on substantially the same axis on a rear portion in a spraying direction of the atomizer main body and the gas-use tank to be connected to the coupler is arranged to be positioned substantially on the same axis in the spraying direction of the coating composition.

8. The atomizer according to claim 6, wherein the coupler is installed on substantially the same axis on a rear portion in a spraying direction of the atomizer main body and the gas-use tank to be connected to the coupler is located below the atomizer main body so as to be positioned inside a palm of the user's hand.

9. The atomizer according to claim 8, wherein on an outer peripheral face of the gas-use tank, a concave portion along which fingers of the user are put in a state where the gas-use tank is positioned inside the palm of the user's hand is formed.

10. The atomizer according to claim 6, wherein the coupler is installed so as to intersect with the spraying direction of the coating composition, and the gas-use tank to be connected to the coupler is located below the atomizer main body so as to be positioned inside a palm of the user's hand.

11. The atomizer according to claim 10, wherein on an outer peripheral face of the gas-use tank, a concave portion along which fingers of the user are put in a state where the gas-use tank is positioned inside the palm of the user's hand is formed.

12. The atomizer according to claim 1, wherein the gas supply means is provided with a gas-use tank for housing a compressed gas and a gas-use hose for supplying the compressed gas from the gas-use tank to the atomizer main body, and the gas-use tank is designed to be attachable to an arm of the user of the atomizer main body.

13. The atomizer according to claim 12, wherein the gas-use tank is designed to be attachable to a wrist.

14. The atomizer according to claim 12, wherein the gas-use hose is detachably attached and connected to at least either the atomizer main body or the gas-use tank.

15. The atomizer according to claim 12, wherein the gas-use tank includes a tank main body having a first end and a second end, the tank main body is curved into a substantially C-shape defining a central opening and the first end and the second end spaced from one another; a coupling metal fitting at the first end or at the second end for use in connecting the gas-use hose to the tank main body, and the tank main body is formed from a flexible material.

16. The atomizer according to claim 12, wherein the tank main body is provided with an attaching member that is attachable to an arm, with the tank main body being formed on the attaching member.

* * * * *